United States Patent [19]

Erickson et al.

[11] 4,344,346

[45] Aug. 17, 1982

[54] MUSICAL LIGHT TOY

[75] Inventors: Erick E. Erickson, Chicago; Gunars Licitis, Sr., Lombard, both of Ill.

[73] Assignee: Marvin Glass & Associates, Chicago, Ill.

[21] Appl. No.: 192,085

[22] Filed: Sep. 29, 1980

[51] Int. Cl.[3] ..... G10H 3/06; G10H 3/03

[52] U.S. Cl. ..... 84/1.18; 84/1.28; 84/DIG. 19

[58] Field of Search ..... 84/1.18, 1.01, 1.28, 84/1.03, DIG. 19; 369/116, 117, 118

[56] References Cited

U.S. PATENT DOCUMENTS

| | | | |
|---|---|---|---|
| 3,309,454 | 3/1967 | Cutler et al. | 84/1.18 |
| 3,405,223 | 10/1968 | Pavia | 84/1.18 |
| 3,647,927 | 3/1972 | Chang et al. | 84/1.18 |
| 3,800,059 | 3/1974 | Pavia | 84/1.18 |
| 4,018,448 | 4/1977 | Di Matteo | 84/1.18 |
| 4,127,049 | 11/1978 | Ichigaya | 84/1.18 |

FOREIGN PATENT DOCUMENTS

| | | | |
|---|---|---|---|
| 2316802 | 1/1977 | France | 84/DIG. 19 |

OTHER PUBLICATIONS

Skutt, "Lazy Man's Cq-er", QST, Oct. 1961, pp. 62-64.

*Primary Examiner*—J. V. Truhe
*Assistant Examiner*—Forester W. Isen
*Attorney, Agent, or Firm*—Mason, Kolehmainen, Rathburn & Wyss

[57] ABSTRACT

A disc having holes in the periphery thereof is moved by successive increments so that the holes are successively brought into alignment with a photocell. The diameters of successive ones of the holes correspond to the pitch of successive tones in a musical selection. A tone generator is employed to develop a tone signal which varies in pitch in accordance with the diameter of the holes in the disc.

12 Claims, 6 Drawing Figures

MUSICAL LIGHT TOY

BACKGROUND OF THE INVENTION

1. Field of the Invention

The present invention relates to musical toys and more particularly to a musical toy in which photoelectric means are employed to develop the successive tones of a predetermined musical selection.

2. Description of the Prior Art

Various arrangements have been employed heretofore to provide different types of musical instruments which employ photocells to develop different tone signals. Examples of such arrangements are shown, for example, in Bartok et al U.S. Pat. No. 2,751,573, Heinzo U.S. Pat. No. 3,405,222, Brouwer U.S. Pat. No. 4,197,671, Martin U.S. Pat. No. 3,660,587, Nelson U.S. Pat. No. 3,749,808, Williams U.S. Pat. No. 3,140,337 and Chang et al U.S. Pat. No. 3,647,927.

While these musical instruments are generally suited for their intended purpose, they are generally quite complex and involve arrangements which cannot be readily incorporated in a low-cost mass-producible toy.

It is, therefore, an object of the present invention to provide a new and improved musical toy which is of simple construction and whereby a simple musical selection can be played by successively depressing a common control key to generate the successive tones of the musical selection.

It is another object of the present invention to provide a new and improved musical toy wherein any one of a series of discs provided with holes of different diameter in the periphery thereof may be selectively employed to play a predetermined musical selection by advancing the disc in increments past a photoelectric generator in response to the successive depression of a common control key.

SUMMARY OF THE INVENTION

Briefly considered, the musical toy of the present invention comprises a base member on which is mounted a rotatable hub adapted to receive any one of a plurality of discs, each disc having a plurality of holes in the periphery thereof. The diameter of successive ones of the holes in the disc corresponds to the pitch of successive tones of a predetermined musical selection when the disc is rotated in a predetermined direction. A control lever is pivotally mounted on the base and interconnected with the rotatable hub so that a disc which has been mounted on the hub is advanced by a predetermined increment equal to the spacing between holes in the disc in response to each depression of the common control lever. A photocell is mounted on the base member behind the holes in the disc so that it receives ambient light through successive holes as the disc is incrementally advanced. A tone generator is employed to develop an audible tone signal each time the key is depressed, the pitch of the tone generator varying in accordance with the diameter of the opening in the front of the photocell.

BRIEF DESCRIPTION OF THE DRAWINGS

The invention both as to its organization and method of operation, together with further objects and advantages thereof, will best be understood by reference to the following specification taken in connection with the accompanying drawings in which.

DESCRIPTION OF THE PREFERRED EMBODIMENT

Figure 4:
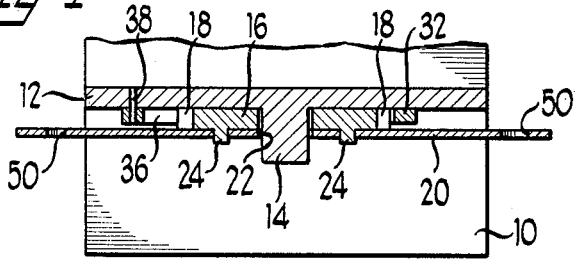
FIG. 4 is a sectional view taken along the line 4—4 of FIG. 2.

Referring now to the drawings, a base member 10 is provided which supports an upstanding central wall 12 provided with a forwardly extending central boss 14 therein. A hub member 16 is rotatably mounted on the boss 14 and is provided with a series of ratchet teeth 18 in the periphery thereof. A thin disc 20, which is provided with a central aperture 22 which fits over the boss 14 is also provided with a pair of locating apertures which fit over a pair of forwardly extending lugs 24 on the hub 16 as best illustrated in FIG. 4. The lugs 24 are preferably provided so that the disc 20 may be snapped over these lugs and retained in position during the playing of the musical selection.

Figure 1:
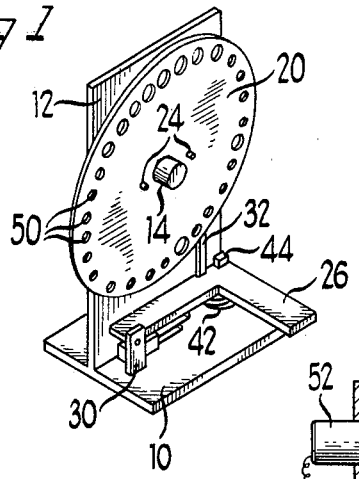
FIG. 1 is a perspective view of the musical toy of the present invention.
Figure 2:
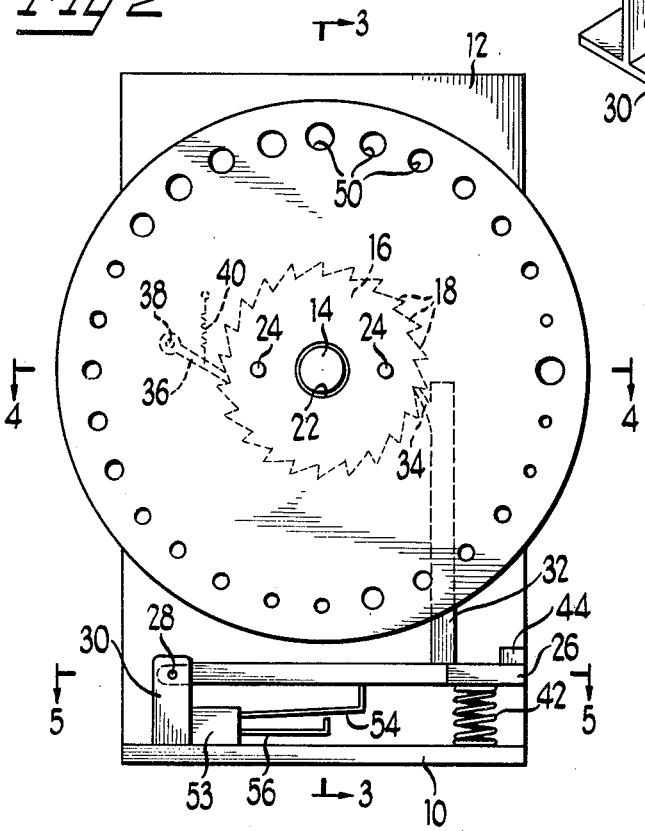
FIG. 2 is a front elevational view of the toy of FIG. 1.
Figure 3:
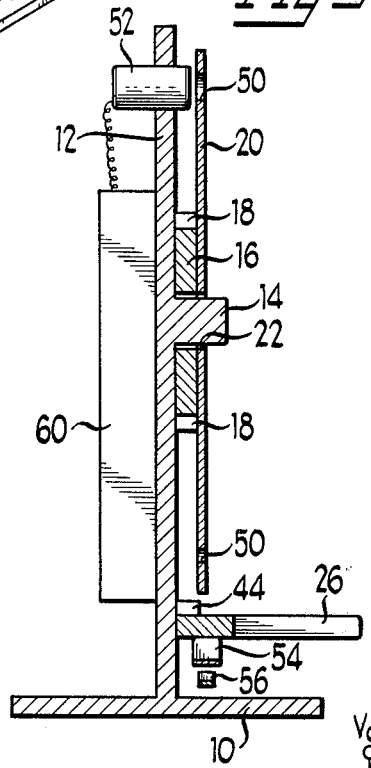
FIG. 3 is a sectional view taken along the line 3—3 of FIG. 2.
Figure 5:
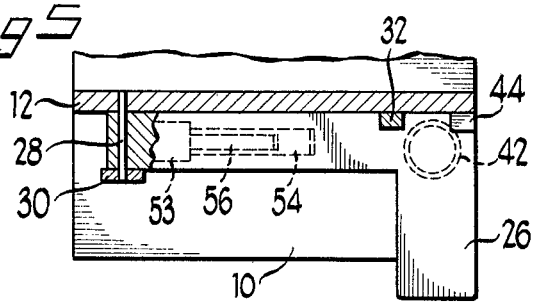
FIG. 5 is a sectional view taken along the line 5—5 of FIG. 2.

The hub 16 with the attached disc 20 is arranged to be advanced by predetermined increments in a counterclockwise direction as viewed in FIG. 2 upon successive actuations of a common control key or lever 26. The lever 26 is pivotally mounted on a pin 28, the pin 28 being supported between an upstanding post 30 on the base member 10 and the vertical wall 12, as best illustrated in FIG. 5. An upstanding arm 32 is formed integrally with the control key 26 and is provided with an offset pawl portion 34 which is adapted to engage the ratchet teeth 18 of the hub 16. A keeper pawl 36 is pivotally mounted on the pin 38 in the wall 12 and is spring biased into engagement with the ratchet teeth 18 by means of the spring 40. A coil spring 42 is positioned between the control key 26 and the base member 10 and normally urges the key 26 upwardly into engagement with a stop lug 44 provided on the wall 12.

When the key 26 is depressed the tang or pawl 34 on the arm 32 rides down the sloping side of a ratchet tooth 18 while the keeper pawl 36 prevents the hub 16 from rotating in a clockwise direction. When the key 26 has been depressed by a sufficient amount, the tang 34 moves beneath the edge of one of the teeth 18 so that when the key 26 is released and the spring 42 returns the key to the normal position shown in FIG. 2 the upward movement of the arm 32 rotates the hub 16 and musical disc 20 by a predetermined increment in the counterclockwise direction. Accordingly, the disc 20 is advanced in predetermined increments upon successive actuations of the key 26 each time the key is returned to the position in engagement with the stop 44.

In accordance with an important aspect of the present invention the disc 20 is provided with a series of openings 50 in the periphery thereof which are arranged successively to be moved into alignment with a photocell 52 which is mounted in the wall 12 behind the disc 20. Each time the key 26 is depressed and released the disc 20 is advanced by a predetermined increment equal to the spacing of the ratchet teeth 18, there being provided a hole 50 for each of the ratchet teeth 18 so that when the disc 20 is advanced by the amount of one ratchet tooth the next hole 50 in the disc 20 is moved into alignment with the photocell 52. The diameters of successive ones of the holes 50 in the disc 20 are made to correspond to the pitch of successive notes of a predetermined musical selection. Accordingly, this musical selection may be played by a child by depressing the key 26 once for each note of the musical selection. More particularly, an arrangement is provided so that when the key 26 is depressed the amount of ambient light received by the photocell 52 through the opening 50 which is then in alignment with the photocell 52 is employed to generate an audible tone having a pitch which corresponds to a predetermined note of the musical selection represented by the series of holes 50 on the disc 20. When the key 26 is released the disc 20 is advanced so that the next hole 50 is brought into alignment with the photocell 52, and when the key 26 is thereafter depressed this next tone is generated.

In accordance with a further aspect of the present invention, the audible tone generator is controlled so that it develops a tone signal corresponding to the note of the musical selection only when the key 26 is depressed so that as the key 26 moves back to its normal position in engagement with the lug 44 and the disc 20 is advanced, no tone signal is produced. To this end, a switch 53 is mounted on the base member 10 and includes an upper switch arm 54 having a right angle end portion in engagement with the underside of the key 26 and a lower switch arm 56. When the key 26 is depressed the switch arms 54, 56 are connected together and close a circuit to enable the development of an audible tone signal in accordance with the amount of ambient light then being received by the photocell 52. It will be noted that by holding the key 26 depressed the child can prolong the duration of the developed tone so that the child is responsible for producing the correct duration of each note of the prerecorded selection although he has no control over the selection of the pitch of successive notes of this selection. Preferably, an indicia is provided on the disc 20 corresponding to the start of the musical selection. The child manually moves the disc to the starting point by rotating the disc counterclockwise until this indicia is aligned with the photocell 52.

Figure 6:
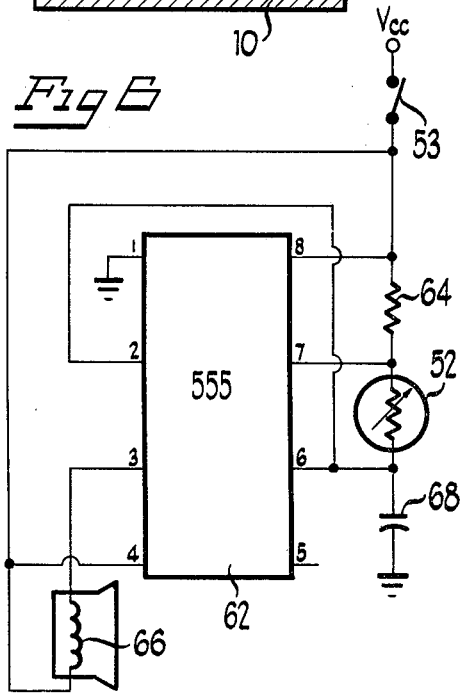
FIG. 6 is a schematic diagram of the circuit arrangement employed to develop successive audible tones in the toy of FIG. 1.

Considering now the manner in which an audible tone signal is developed which is proportional to the ambient light received by the photocell 52, reference may be had to FIG. 6 wherein a schematic diagram of the circuit components of the tone generator are disclosed. These circuit components are preferably enclosed in a housing 60 provided on the rear side of the wall 12, these circuit components including suitable batteries identified as the voltage source $V_{cc}$ in FIG. 6. When the switch 53 is closed by depression of the key 26 a suitable battery voltage is supplied to a timer 62 which is preferably of the commercial type 555. The photocell 52 is connected between pins 6 and 7 of the timer 62 and a resistor 64 is connected between pins 7 and 8 of the timer 62. The B plus voltage is supplied to pins 4 and 8 of the timer 62 whenever the switch 53 is closed and a loud-speaker 66 is connected between the output terminal 3 of the timer 62 and the B plus terminal. A timing capacitor 68 is connected between terminal 6 and ground and the terminals 2 and 6 of the timer 62 are connected together so that this timer operates in its astable mode.

Considering now the operation of the tone generator shown in FIG. 6, when the switch 53 is closed, the capacitor 68 is charged through the resistor 64 and photocell 52 to a predetermined level and is thereafter discharged through a path which includes only the photocell 52. The photocell 52 which may be a commercial cadmium sulfide cell of any suitable type, and has a resistance value which varies from approximately ten thousand ohms when a large diameter hole 50 is opposite the photocell 52 to a value of one or two megohms when a very small diameter hole 50 is opposite this photocell. For example, if the diameter of the photocell 52 is $\frac{3}{8}$ inch, a $\frac{3}{8}$ inch diameter hole 50 in the disc 20 would provide maximum light to the photocell and establish the upper frequency limit of the tone generator. By varying the diameter of the hole 50 down to the size of a pin hole a range of resistance values may be produced in the photocell 52 which are equivalent to several octaves of a musical scale, it being recalled that the frequency of a musical tone is doubled each octave. Accordingly, a musical composition having a relatively wide range of notes may be prerecorded on the disc 20.

The timer 62 develops a square wave corresponding in frequency to the charging and discharging rates of the capacitor 68 which, as indicated above, is dependent upon the resistance of the photocell 52. In order that the charging and discharging rates may be substantially equal, so that an essentially symmetrical square wave is developed, the resistor 64 is chosen to have a value of one thousand ohms so that the photocell 52 is the major contributing resistance for both charging and discharging of the capacitor 68. The capacitor 68 may have a value of 1. microfarads. The output square wave of the timer 62 is supplied directly to the loud-speaker 66 which is contained within the housing 60 and provides an audible tone having a pitch which varies in accordance with the diameter of successive ones of the openings 50 of the disc 20. However, it will be recalled that the switch 53 is closed only during periods when the key 26 is depressed and is opened each time the arm 32 is moved upwardly to advance the disc 20. Accordingly, the tone generator of the present invention is disabled during periods when the disc 20 is being moved to bring the next hole 50 into alignment with the photocell 52.

As discussed heretofore, the arrangement of the present invention enables different selections to be played by the child by simply removing the disc 20 from the hub 16 and inserting a different disc over the lugs 24. It should also be noted that the child can modulate the ambient light being received by the photocell 52 through any one of the openings 50 by moving his hand closer to the opening so that different musical effects can be produced with the musical toy of the present invention.

While there has been illustrated and described a single embodiment of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. A musical toy, comprising a rotatably mounted disc having a series of openings therethrough which are equally spaced apart at a common radius from the center thereof, the cross-sectional area of successive ones of said openings corresponding to the pitch of successive notes of a musical selection when said disc is rotated in a predetermined direction, means for advancing said disc by successive increments equal to the space between successive ones of said openings, light sensitive means mounted to receive light through successive ones of said openings as said disc is successively advanced by said advancing means, and means connected to said light sensitive means for generating an audible tone having a pitch which varies in accordance with the cross-sectional area of successive ones of said openings.

2. A musical toy as set forth in claim 1, wherein said disc advancing means comprises a control member, means normally biasing said control member to a first position, and means responsive to manual actuation of said control member to a second position for enabling said tone generator.

3. A musical toy as set forth in claim 2, wherein said control member comprises a pivotally mounted lever, and switch means controlled in response to manual depression of said lever for enabling said tone generator.

4. A musical toy as set forth in claim 3, which includes coil spring means for biasing said pivotally mounted lever to said first position.

5. A musical toy as set forth in claim 2, which includes a ratchet carried by and rotatable with said disc, and pawl means connected to said control member for engaging said ratchet and advancing said disc by said increment each time said control member is moved from said second position to said first position.

6. A musical toy as set forth in claim 3, which includes a ratchet connected to and rotatable with said disc, and pawl means including an upstanding post on said pivotally mounted lever for engaging said ratchet and advancing said disc by said increment each time said lever is returned to said first position.

7. A musical toy, comprising a movable member having a series of openings therethrough which are spaced equal distances from one another, the diameter of successive ones of said series of openings corresponding to the pitch of successive notes of a musical selection, means for moving said member in successive increments equal to said spacing between said openings, light sensitive means positioned to receive ambient light through each of said openings in succession as said member is moved by said successive increments, and means connected to said light sensitive means for generating a series of audible tones each of which has a pitch proportional to the light received by said light sensitive means through one of said openings.

8. A musical toy as set forth in claim 7, wherein said light sensitive means comprises a photocell and said tone generator includes a capacitor, and means including said photocell for charging said capacitor to a predetermined level and discharging said capacitor.

9. A musical toy as set forth in claim 8, which includes means connected to said capacitor for developing an essentially square wave signal having a frequency proportional to the resistance of said photocell.

10. A musical toy as set forth in claim 9, which includes loud-speaker means energized by said square wave signal for generating said audible tones.

11. A musical toy comprising a vertical support member, a hub rotatably mounted on said support member, a disc removably supported on said hub and having a series of equally spaced openings near the periphery thereof, said openings having cross-sectional areas corresponding to the pitch of successive notes of a musical selection, a pivotally mounted control key, means responsive to successive actuations of said control key for advancing said disc by successive increments equal to the spacing between said openings, a photocell mounted on said support member to receive ambient light through successive ones of said openings during periods between advancement of said disc, and means connected to said photocell for generating an audible tone having a pitch which varies in accordance with the cross-sectional area of successive ones of said openings.

12. The musical toy of claim 11, wherein said hub is provided with a series of ratchet teeth on the periphery thereof corresponding in number to said openings in said disc, and means connected to said control key for engaging said ratchet teeth and advancing said hub by one tooth each time said control key is actuated.

* * * * *